United States Patent [19]

Weinstein

[11] 3,998,540

[45] Dec. 21, 1976

[54] REPOSITIONING SYSTEM FOR VIEWING AND PROJECTION ELEMENTS OF A REPRODUCING APPARATUS

[75] Inventor: Paul Weinstein, Rochester, N.Y.

[73] Assignee: Xerox Corporation, Stamford, Conn.

[22] Filed: Nov. 24, 1975

[21] Appl. No.: 634,966

[52] U.S. Cl. ..... 355/8; 355/11; 355/57; 355/66

[51] Int. Cl.[2] ..... G03G 15/28

[58] Field of Search ..... 355/8, 11, 3 R, 14, 355/55, 57, 60, 66

[56] References Cited

UNITED STATES PATENTS

| | | | |
|---|---|---|---|
| 3,837,743 | 9/1974 | Amemiya | 355/57 X |
| 3,884,574 | 5/1975 | Doi et al. | 355/8 X |

*Primary Examiner*—R. L. Moses

[57] ABSTRACT

A multi-mode reproducing apparatus having an improved system for positioning the viewing and projection elements therein for purposes of moving original exposure. Variable magnification copying is provided by holding a scanning mirror system in a fixed position to view a document which is advanced past its viewing domain. A system for repositioning the mirrors for conjugate change in accordance with one embodiment includes a device for uncoupling one of the mirrors from the drive system through the use of a selectively actuable stop mechanism and a quick-connect and disconnect type of coupling between the drive system and the mirror. In accordance with an alternative embodiment a friction clutch and selectively actuable stop mechanism allows one mirror to be stopped while another one continues to be driven to its stop position. When the mirrors are returned to their home position their original coordinated arrangement is restored.

22 Claims, 7 Drawing Figures

REPOSITIONING SYSTEM FOR VIEWING AND PROJECTION ELEMENTS OF A REPRODUCING APPARATUS

BACKGROUND OF THE INVENTION

This invention relates to a multi-mode reproducing apparatus preferably of the electrostatographic type. The apparatus preferably includes means for copying documents selectively at a plurality of magnifications. The apparatus includes an improved system for positioning the optical elements therein for purposes of moving original exposure.

A variety of electrostatographic reproducing machines are commercially employed which have different modes of operation. One type of machine utilizes a moving original exposure system wherein an original document is moved past a fixed slit optical system for projecting an image onto a moving photoconductive surface. These machines include a means for changing the magnification of the projected image and the speed of the moving original to provide reduction copies. The magnification changing systems include various systems for repositioning the optical elements. Exemplary of patents in this area are U.S. Pat. Nos. 3,076,392 to Cerasani et al., and 3,649,114 to Vlach et al.

Other machines have been adapted to copy stationary original documents at a variety of magnifications or reductions through the use of a scanning optical system with different scanning speeds and conjugate changing by repositioning optical elements. Exemplary of patents in this area are U.S. Pat. Nos. 3,476,478 to Rees, Jr.; 3,542,467 to Furgeson; U.S. Pat. No. 3,614,222 to Post; and 3,837,743 to Amemiya.

Another type of variable magnification copier, in which full frame flash exposure is made of a stationary original document, is shown, for example, in U.S. Pat. No. 3,778,147 to E. G. Reedhil et al. It discloses delaying the application of the flash energizing pulse in response to the selected magnification ratio.

The aforenoted machines are adapted to provide one or more modes of copying having different magnifications. Other forms of multi-mode copiers are available commercially. For example, in the Xerox 3100 LDC machine an optical system is provided which enables the machine to copy from a stationary original in a first scanning mode or from a moving original in a second fixed optical mode. This latter mode is particularly adapted for copying documents larger than the conventional viewing platen size. U.S. Pat. No. 3,900,258 to Hoppner et al. [1] is illustrative of a machine similar in many respects to the 3100 LDC machine.

Reproducing apparatuses including the capability of making copies from both moving and stationary originals are also described in U.S. Pat. No. 3,833,296 to Vola, and in IBM Technical Disclosure Bulletin, Vol. 12, No. 1, at page 173, June 1969.

In U.S. applications Ser. No. 549,684 to Bar-on, and U.S. application Ser. No. 598612to Hughes, there are disclosed reproducing machines wherein belt type document feeders are utilized for advancing documents over a platen and past a fixed scanning optical system for providing moving original exposure. In the latter application a moving original exposure mode for reduction copying may be employed.

It has been found desirable, to provide a multi-mode reproducing apparatus having various unique features of the 3100 LDC machine, including its extremely compact size, but also having the capability of reduction copying.

One approach to such a machine is described in U.S. application Ser. No. 588,971 to Hoppner et al. [2]. In that application a multi-mode reproducing apparatus is provided including both moving and stationary original exposure modes, with at least two modes of moving original exposures at differing copy image magnifications.

The particular optical system described in the Hoppner et al. [2] application is similar in most respects to that described in application Ser. No. 588,974 to Spinelli et al. An add reflector is selectively positionable into the optical path to combine with the half-rate mirror to form a reflection cavity and increase the object distance for magnification change. The lens is movable relative to the optical path to adjust the conjugate distance. The add mirror does not form a part of the scanning optical arrangement so that no adjustment is necessitated in the drives of the scanning mirrors irrespective of which magnification mode is selected.

In the apparatus of the Hoppner et al. [2] application, only two modes of moving original exposure are shown although additional modes could be provided. One at a nominal magnification wherein the add mirror is positioned out of the optical path and one at a reduced magnification wherein the add mirror is positioned in the optical path. If it is desired to provide multiple reduction modes, then it would be necessary not only to translate the lens to a still different position, but also to adjust the position of the add mirror to again change the appropriate conjugate.

Another approach to such a machine is described in U.S. application Ser. No. 627,432 to Bierworth et al. In that application a reproducing apparatus is described with plural modes of moving original exposure at different copy image magnifications. A plurality of document viewing positions are provided corresponding to different desired copy image magnifications. The documents are fed past the viewing positions at a velocity which is proportionally synchronized to the velocity of the imaging surface. An optical system for strip-wise viewing the document is positioned selectively at one of the viewing positions for projecting an image thereof onto the imaging surface selectively at one of the plurality of magnifications corresponding to the viewing position.

The viewing and projection system in Bierworth et al preferably comprises an optical means including at least one optical element arranged for movement along a given path to enable it to view the document at any of the viewing positions, and a means for selectively fixing the optical element along the path to view the document at the desired one of the viewing positions. Any desired system could be utilized for positioning the optical elements in this system for purposes of moving original exposure at the selected magnification.

The specific approaches which are disclosed in that application for positioning the optical elements comprise the basis of the present invention along with some additional alternatives which will be described hereafter. The optical element positioning systems of this invention are believed to provide a considerable improvement over prior art systems and are uniquely suited to the application described.

In U.K. Pat. No. 1,336,819 a high speed copier system is disclosed with varying projected image magnifications. Varying magnification is provided by repositioning a lens and mirror using a single drive motor operating through separate slip clutches. The slip clutches allow the motor to continue to drive the lens or mirror even though one of them has been stopped.

SUMMARY OF THE INVENTION

In accordance with this invention a multi-mode reproducing apparatus is provided having an improved means for positioning the viewing and projection elements therein for purposes of moving original exposure. Preferably the reproducing apparatus includes means for copying selectively at a variety of copy image magnifications.

The optical element positioning system of this invention is uniquely suited for use in conjunction with mirror scanning systems of the type described in the background of this invention. In those systems one or more mirrors are scanned in a coordinated manner to provide a flowing light image of the original document. When one attempts to provide variable magnification capability it is necessary to change the conjugate relationship of the optical system. This becomes a complex matter in multiple mirror scanning systems because it is usually necessary to change the distance between the mirrors to provide conjugate change and any such change requires modifications to the drive arrangement for the mirrors.

In accordance with this invention varying magnification copying is provided by moving original exposure wherein preferably a scanning mirror system is held in a fixed position to view a document which is advanced past its viewing domain. The system of this invention for repositioning the mirrors for conjugate change provides an approach which will not require complex modifications to the mirror drive system. This is accomplished in accordance with one embodiment by uncoupling one of the mirrors from the drive system through the use of a selectively actuable stop mechanism and a quick connect or disconnect type of coupling between the drive system and the mirror. In accordance with an alternative embodiment a slip clutch and selectively actuable stop mechanism allows one mirror to be stopped while another one continues to be driven. The systems of the present invention are self-restoring in that when the mirrors are returned to their home positions their original coordinated arrangement is restored.

In accordance with one preferred embodiment the apparatus includes an imaging surface arranged for movement at a given velocity and a means for viewing a document and for projecting an image thereof onto the imaging surface. The viewing means includes a first optical element and a means for supporting the first optical element for movement along a first path of travel between a home position and an end of travel position. A drive means moves the optical element between its respective home and end of travel positions. A flexible member is used to couple the drive means to the optical element. The drive means is arranged to advance the flexible member in a first direction to move the optical element from the home position to the end of travel position or in a generally opposing second direction to return the optical element to its home position.

Means are provided for selectively stopping the optical element along its path of travel at a desired position between the home and end of travel positions. In accordance with this invention a unique system is provided for automatically uncoupling the flexible member from the optical element in response to the stopping of the element at its desired position and the continued movement of the flexible member in its first direction. Means are also provided for automatically recoupling the flexible member to the optical element upon movement of the flexible member in the second direction to return the element to its home position.

This embodiment of the invention offering as it does a unique optical element positioning and drive system is applicable to a variety of viewing and projection systems for use in reproduction apparatuses including and most preferably the system described in the aforenoted Bierworth et al. application.

The automatic uncoupling and recoupling system preferably comprises a quick connect or disconnect latch and catch arrangement and most preferably the latch and catch are coupled magnetically.

In accordance with an alternative embodiment of the present invention an optical element positioning and drive system is provided for a reproducing apparatus of the Bierworth et al. type comprising the following elements. An imaging surface arranged for movement at a given velocity and a plurality of document viewing positions corresponding to different desired copy image magnifications. Means for viewing the document selectively at any desired one of the viewing positions and for projecting an image thereof onto the imaging surface selectively at one of the plurality of magnifications corresponding to the one viewing position. The viewing means includes a first optical scanning element and a second optical scanning element. Means are provided for supporting the first and second elements for movement along first and second paths of travel respectively between their home positions and their end of travel positions. A drive means moves the elements between their respective home and end of travel positions and coordinates their movement to maintain a constant conjugate distance during scanning movement. A document feeder is arranged to advance the document past the viewing positions at a velocity proportionally synchronized to the velocity of the imaging surface. The optical distance between the first and second scanning optical elements is changed by a selectively actuable means arranged along the first path of travel for selectively stopping the first element at a desired position while the second element continues to advance along its path of travel. Means are provided for fixing the second element at a desired position along its path of travel after the stopping of the first element.

The system of the alternative embodiment may preferably employ the automatic uncoupling and recoupling system of the previous embodiment or it may preferably employ slip clutches.

Accordingly, it is an object of the present invention to provide a reproducing apparatus having an improved system for positioning the viewing and projection elements therein for purposes of moving original exposure.

It is a further object of this invention to provide an apparatus as above including means for copying selectively at a variety of copy image magnifications.

These and other objects will become more apparent from the following description and drawings.

DETAILED DESCRIPTION OF THE PREFERRED EMBODIMENTS

The optical element positioning systems of the present invention are uniquely suited for use in an apparatus as described in the above-noted Bierworth et al. application and, therefore, the Bierworth et al. apparatus and the use of the present systems in it will be described in detail.

Figure 1:
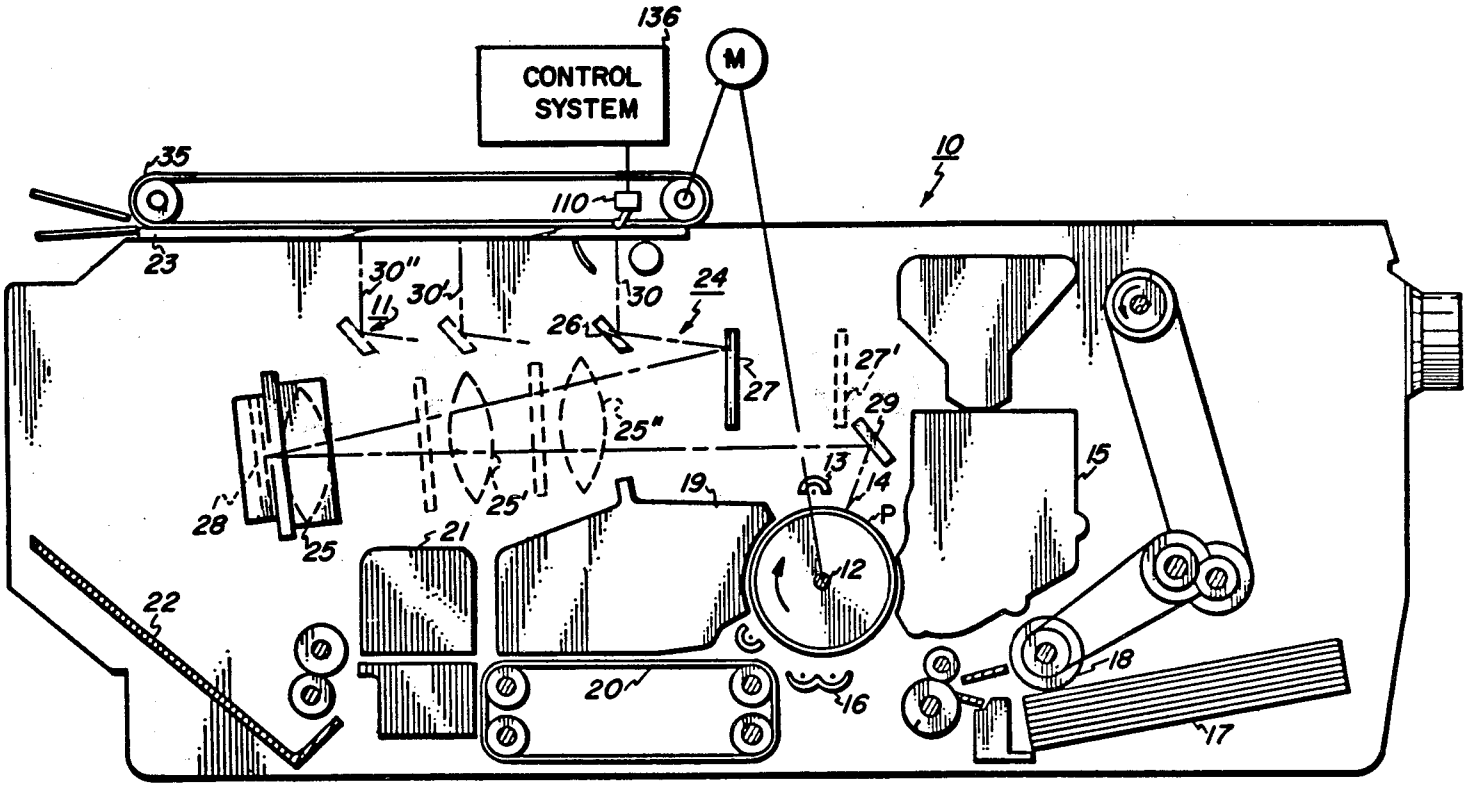
FIG. 1 is a schematic side view of a reproducing apparatus in accordance with the present invention.

Referring now to FIG. 1, there is shown by way of example an electrostatographic reproducing machine 10 which incorporates the apparatus 11 of the present invention. The reproducing machine 10 depicted in FIG. 1 illustrates the various components utilized therein for xerographically producing copies from an original. Although the apparatus of the present invention is particularly well adapted for use in an automatic xerographic reproducing machine 10, it should become evident from the following description that it is equally well suited for use in a wide variety of electrostatographic systems and is not necessarily limited in its application to the particular embodiment shown herein.

Basically, the xerographic processor includes a rotatably mounted photosensitive or photoconductive drum P which is supported upon a horizontally extended shaft 12. The drum is driven in the direction indicated whereby its photoconductive surface is caused to pass sequentially through a series of xerographic processing stations.

The practice of xerography is well-known in the art, and is the subject of numerous patents and texts, including *Electrophotography* by Schaffert, published in 1965, and *Xerography and Related Processes*, by Dessauer and Clark, published in 1965. Therefore, the various processing steps involved will be briefly explained below in reference to FIG. 1. Initially, the photoconductive drum surface is uniformly charged by means of a corona generator 13 positioned within a charging station located at approximately the 12 o'clock drum position. The charged drum surface is then advanced into an imaging station 14 wherein a stripwise flowing light image of an original document to be reproduced is projected onto the charged drum surface thus recording on the drum a latent electrostatic image containing the original input scene information. Next, subsequent to the exposure step in the direction of drum rotation is a developing station 15 wherein the latent electrostatic image is rendered visible by applying an electroscopic marking powder (toner) to the photoconductive surface in a manner well known and used in the art. The now visible image is then forwarded into a transfer station 16 wherein a sheet of final support material is brought into overlying moving contact with the toner image and the image transferred from the plate to the support sheet by means of a second corona generator 16.

In operation, a supply of cut sheets are supported within the machine by means of a paper cassette 17. A pair of feed rollers 18 are arranged to operatively engage the uppermost sheet in the cassette so as to first separate the top sheet from the remainder of the stack and then advance the sheet into the transfer station in synchronous moving relationship to the developed image on the photoconductive plate surface. The motion of the feed rollers is coordinated with that of the rotating drum surface, as well as the other machine components through the main drive system whereby the support sheet is introduced into the transfer station in proper registration with the developed toner image supported on the xerographic plate. For further information concerning this type of sheet feeding mechanism, reference may be had to U.S. Pat. No. 3,731,915.

After transfer, but prior to the reintroduction of the imaged portion of the drum into the charging station, the plate surface is passed through a cleaning station 19 wherein the residual toner remaining on the plate surface is removed. The removed toner particles are collected within a container where they are stored subject to periodic removal from the machine.

Upon completion of the image transfer operation, the toner bearing support sheet is stripped from the drum surface and placed upon a moving vacuum transport 20 which serves to advance the support sheet into a thermal fusing station 21 wherein the toner image is permanently fixed to the sheet. The copy sheet with the fused image thereon is forwarded from the fuser into a collecting tray 22 where the sheet is held until such time as the operator has occasion to remove it from the machine.

Normally, when the copier is operated in a conventional mode, the original document to be reproduced is placed image side down upon a horizontal transparent viewing platen 23 and the stationary original then scanned by means of the moving optical system 24. The scanning system 24 fundamentally consists of a lens 25, and a pair of cooperating movable scanning mirrors 26 and 27. The lens is basically a half-lens objective having a reflecting surface 28 at the stop position to simulate a full lens system. For further description and greater details concerning this type of optical scanning system reference is had to U.S. Pat. No. 3,832,057 to Shogren.

In practice, mirror 26, herein referred to as the full rate scan mirror, is caused to move from a home position, directly below the left hand margin of the platen to an end of scan position below the opposite margin of the platen. The rate of travel of the mirror 26 is synchronized to the peripheral velocity of the rotating xerographic drum surface P. The second mirror 27 is simultaneously caused to move in the same direction as the scanning mirror at half the scanning rate. As the two mirrors sweep across the platen surface, a stripwise image of each incremental area thereon viewed by the full rate mirror is reflected towards the half rate mirror which, in turn, redirects the image back to the half lens system. The reflecting surface, positioned at the lens stop position, reverses the entering light rays and redirects the light rays back towards a stationary mirror 29 positioned directly above the drum surface at the exposure station 14. In this manner a flowing light image containing the original input scene information is focused upon the charged photoconductive plate.

In accordance with this embodiment it is possible to provide as many different copy image magnifications or reductions as are desired and potentially to infinitely vary such magnifications without the necessity of an add mirror.

Figure 2:
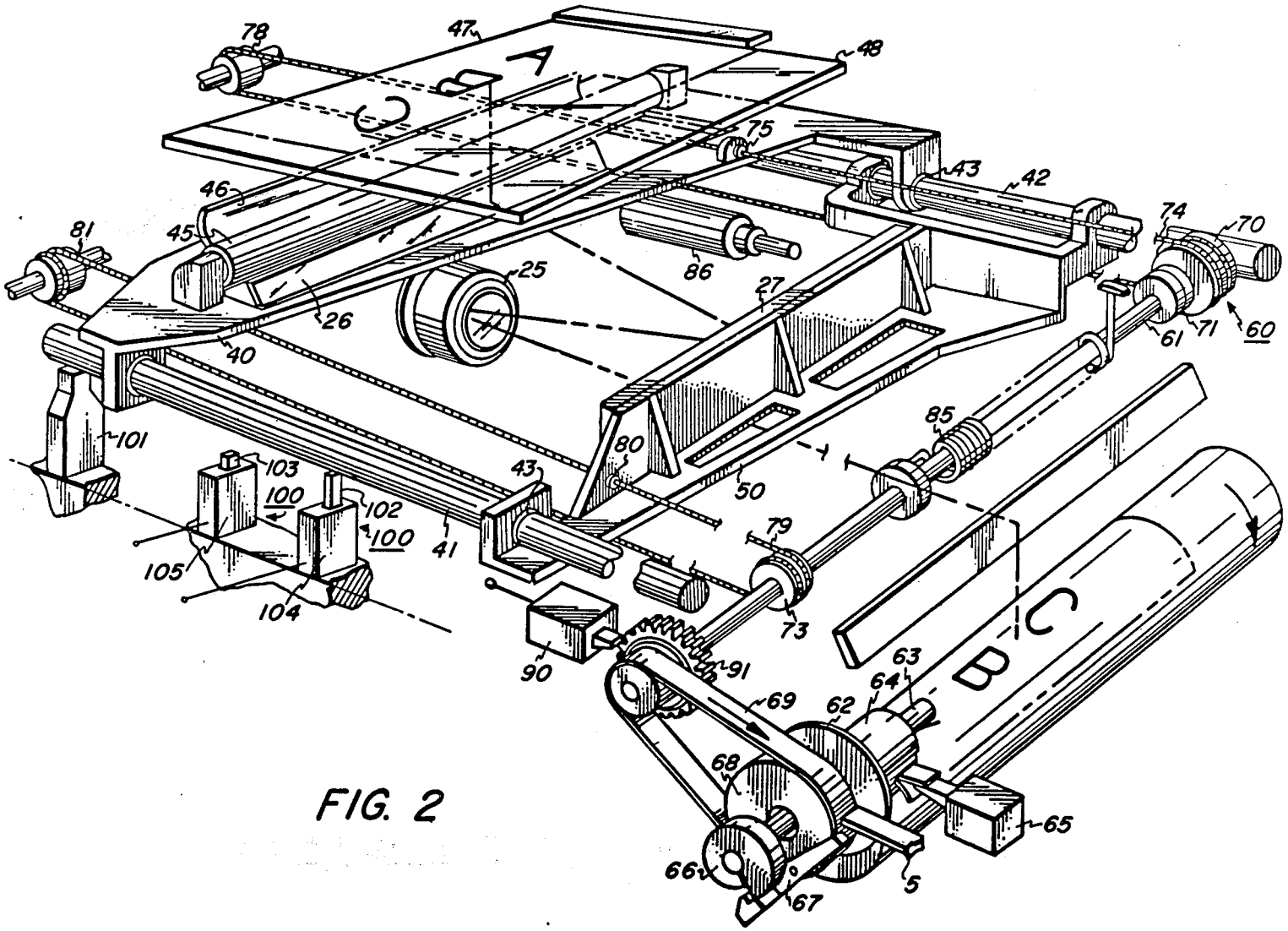
FIG. 2 is a perspective view of an optical exposure system used in the apparatus of FIG. 1.

Referring now to FIGS. 1 and 2, this is accomplished by fixing the full rate scanning reflector 26 at one of a plurality of different viewing positions 30, 30', and 30'', etc., along its path of travel, depending on the copy image magnification which is desired. In the embodiment shown a document feeder 35 advances a document over the platen 23 past the optical system 24 which has been fixed at a desired viewing 30 position.

The document feeder 35 is arranged to move the document at a velocity which is synchronous with the velocity of the photosensitive surface P. It is not necessary, however, for the document velocity to be the same as that of the photosensitive surface, but merely that it be proportionally related and synchronized with it. For example, for a 1:1 magnification mode of operation the document would move at the peripheral velocity of the drum. For a reduced magnification mode of operation the document would move at a proportionally increased velocity as compared to the peripheral velocity of the drum.

This synchronization can be accomplished by using a common drive motor M for both the drum and the document feeder as is the case, for example, in a Xerox 3100 LDC copier. A further description of such a drives approach may be had by reference to the Hoppner et al. patents noted in the background.

In the optical exposure system 24 shown in FIGS. 1 and 2, the full rate mirror 26 is supported upon a carriage 40 and the carriage is adapted to move back and forth over the prescribed path of travel below the platen surface 23. To this end the carriage is slidably mounted upon two parallel aligned guide rails 41 and 42 by means of bearings 43. The mirror 26, as positioned upon the carriage 40, extends transversely across the platen surface. Mounted directly behind the scanning mirror on the carriage is an aperture lamp 45 and a reflector 46 which cooperate to illuminate a longitudinally extending strip-like incremental area upon the platen 23 within the viewing domain of the full rate mirror 26. The carriage is adapted to move across the platen at a constant rate whereby the mirror scans successively illuminated strip-like incremental areas on the document beginning at the start of scan margin 47 and terminating at the opposite side of the platen at the end of scan margin 48.

A second movable carriage 50 is also provided upon which is supported the half rate mirror 27. The second carriage 50 is also slidably mounted on the guard rails 41 and 42 by means of bearings 43. The carriage 50 is arranged to move in non-interfering relationship with the carriage 40 throughout the scanning operation. The mirror 27 is positioned on the carriage 50 to receive reflected light rays emanating from the mirror 26 and redirect these rays back towards the stationary lens element 25.

Although any suitable lens can be employed herein a half lens system comprised of a two component split Dagor system is shown. A reflecting surface 28 is positioned at the lens stop position to reverse the receive light rays as they pass through the lens components thus simulating a conventional asymmetrical system.

As illustrated in FIG. 2, a pulley and cable drive system 60 is herein provided to coordinate the movement of the carriages 40 and 50. The mirror carriages are driven via the optics drive shaft 61, the motion of which is regulated by a control mechanism. A gear 62 is operatively connected to the rotating xerographic drum and is arranged to rotate at a predetermined rate therewith. The motion of the gear is imparted to a drive shaft 63 through a wrap around clutch 64, the action of which is regulated by a solenoid 65. Affixed to the output end of the drive shaft 63 is a cam element 66 having a stop face formed therein. A pawl 67 is pinned to the drive pulley 68 which is mounted for free rotation upon the drive shaft 63, and is adapted to periodically translate the motion of the shaft to the pulley.

In the scanning operation at the initiation of the copying cycle the mirrors 26 and 27 are both in their respective home positions, and the wrap around clutch is disengaged. To start a copying sequence, solenoid 65 is energized pulling a latch (not shown) thereby energizing the wrap around clutch 64. This in turn causes the shaft 63 to rotate in timed relationship with the drum. The motor of the shaft is imparted to the pulley 68 via cam 66 and pawl 67 which is engaging stop face and translated to the optics drive shaft 61 by means of a timing belt 69.

A pulley 70 is mounted for rotation with the optics drive shaft 61 by means of a clutch 71. A second pulley 73 is pinned to the drive shaft 61 and is adapted to rotate with the shaft. The outside diameter of the pulley 70 is preferably twice the outside diameter of the second pulley 73 to provide a 2 to 1 coordination in the movement of the respective mirrors 26 and 27.

A full rate drive cable 74 is wrapped about the large diameter pulley 70 with one end of the cable anchored to the carriage 40 by means of an adapter 75 and the opposite end of the cable passing about pulley 78 and being similarly secured to the carriage. This arrangement makes the full rate carriage a part of an endless loop cable system whereby the carriage responds instantaneously and positively to any movement of the optics drive shaft 61. In the embodiment shown, the movement of the half rate mirror 27 is coordinated with that of the full rate mirror 26 by means of a second cable 79 wrapped about the small diameter pulley 73 with one end of the cable anchored to the carriage 50 by means of an adapter 80 and the opposite end of the cable passing about pulley 81 and being similarly secured to the same carriage.

The half rate mirror carriage 50 is continuously repositioned in regard to the full rate mirror carriage by being driven from the same shaft 61. The cable 79 and pulleys 73 and 81 for the half rate carriage 50 have been shown at the inboard end of the apparatus for purposes of clarity, however, they may be positioned anywhere, as desired, and would most likely be positioned adjacent the pulleys 71 and 78 for the full rate mirror carriage 40. It should also be clear to one skilled in the art that any of a variety of mechanical arrangements could be similarly employed to accomplish the coordinated movement of these mirror carriages.

In practice the rate of the mirror 26 is set as desired and the motion of the mirror 27 regulated in respect thereto so as to present a flowing light image of the original at the photoreceptor surface. In this manner the continuous repositioning of the two mirrors can be programmed by controlling the diameter ratio between the large pulley and the small pulley. This ratio is generally selected to be 2 to 1, respectively, so as to maintain a constant conjugate as the mirrors scan.

In the preferred embodiment of the present invention rotation of the cam 66 through approximately 319° will provide a sufficient angular displacement of the mirrors 26 and 27 to their end of scan. At the 319° mark the pawl 67 contacts a striker bar 5 which disengages the pawl from the stop face, thus freeing the drive pulley 68 and as a consequence the optics drive shaft 61 from the input drive mechanism. At this time, the wrap around clutch 64 is still engaged and continues to turn the cam to complete a full 360° of rotation preparatory to the initiation of the next subsequent copying cycle. The release of the optics drive shaft 61 from the main drive begins mirror restoration to the start of scan unless the optics are to be fixed at the end of scan or other desired position.

A wind-up spring 85 is wrapped about the optics drive shaft in the manner illustrated. One end of the spring is locked to the shaft by means of a retainer while the other end of the spring is secured to the machine frame. As the shaft is rotated in the clockwise direction during the scanning phase, the spring is wound to a fully loaded condition at the 319° mark. When the drive pulley 68 is released the loaded spring is permitted to unwind, turning the optics drive shaft in an opposite or counterclockwise direction. This in turn causes the two mirror carriages 40 and 50 to move back over the guide rails toward their start of scan or home positions. In order to conserve valuable machine time, mirror restoration is accomplished in a minimum amount of time preferably within a time period that is considerably shorter than the scanning period.

A dash pot 86 is provided to control the motion of the two carriages during the final portion of the restoration phase of a scanning copying cycle. The dash pot 86 is arranged to physically engage the mirror carriage 40 as it approaches the home position and serves to decelerate the carriage and, thus, the entire system thereby preventing the optics from being disturbed or damaged.

Having thus described a scanning optical system 24 for providing a stationary document mode of exposure, it is necessary to provide some means for fixing the optical system at desired positions for providing moving document modes of exposure. As previously described various well known devices for doing this are available as, for example, that employed in the Xerox 3100 LDC copier, and that described in the above-noted Hoppner et al. 1 and 2 patents.

Referring to FIG. 2, there is shown a solenoid actuated latch 90 which can engage a gear 91 pinned to the optics drive shaft to lock the optics drive shaft 61 while the mirrors 26 and 27 are at any desired position as, for example, the end of scan position as in FIG. 1. The actuation of this latch mechanism 90 may be carried out by timing it from the start of the optics scan by any desired conventional means.

In order to change the projected image magnification to provide, for example, for a reduction mode of operation it is necessary to change the conjugate distance between the lens 25 and the object and image planes. In accordance with this invention this is accomplished by translating the lens 25 to different positions and by changing the optical path length between the full rate mirror 26 and half-rate mirror 27.

Lens 25 translation may be carried out by any desired means as are well known in the art. Of course, by the nature of a half lens with its associated reflector 28 the optical path incident to the lens is reflected back through the lens at some angle relative to the lens axis. When a magnification change necessitates repositioning the lens the repositioning must take account of the divergence of the lens axis and the optical ray path. In the optical system in accordance with this invention the lens 25 and lens reflector 28 are shifted to satisfy conjugate distance requirements and to remain centered on the optical (principal) ray path, as shown in phantom at 25', 25'', etc.

Various devices for translating a lens for changing the projected image magnification of an optical system are known as described in the various patents noted in the background of this invention.

In order to obtain varying projected image magnifications by moving original exposure, it is also necessary to advance the document past the optical viewing system at a velocity which varies depending upon the magnification which is selected. Various drive mechanisms are known which would enable the document feeder 35 to be driven selectively at one of a plurality of desired speeds corresponding to the given magnification or minification selection.

As noted in various of the patents cited in the background of this invention, it has been known in scanning optical systems to change the object plane to lens conjugate relative to the lens to image plane by shifting the lens and the half rate mirror 27 relative to the full rate mirror 26. In accordance with this invention the relative distance between the full rate mirror 26 and the half rate mirror 27 can be increased without expanding the optical cavity. This is advantageous for a compact machine.

Referring to FIG. 1, if one shifts the full rate mirror 26 relative to the half rate mirror 27, from position 30, to position 30' or 30'', the mirrors are still within the original optical cavity. If, on the other hand, the half rate mirror 27 is shifted, as shown in phantom relative to the full rate mirror which is held at position 30, then the half rate mirror would be moved to the position outside the original optical cavity.

With this invention either or both mirrors 26 and 27 could be moved relative to one another to change the conjugate distance without expanding the optical cavity by suitably changing the viewing position of the optical system 24. Preferably, however, the full rate mirror is moved relative to the half rate mirror.

In FIG. 1, three different viewing or imaging positions 30, 30', and 30'' are shown for the mirror 26, however, any desired number of positions and selectable magnifications could be employed. The position 30 shown in solid lines comprises the end of scan position and in this position the relationship between the mirrors 26 and 27 is essentially the same as that in a Xerox 3100 LDC copier and can provide about a 1:1 original image to projected image ratio. If it is desired, however, to provide copy images having different magnification ratios than 1:1, then preferably the mirror 26 is held at a position 30' or 30'', etc., which are prior to its end of scan position and along its path of travel, and the mirror 27 is preferably held at its end of scan position.

In accordance with this invention this may be accomplished by providing selectively actuable stops 100 which intercept the full rate mirror 26 to hold it at a given position 30', 30'', etc., while the half rate mirror continues to its end of scan position. The full rate mirror carriage drive pulley 70, as noted above, is mounted to the optics drive shaft 61 by means of a clutch 71. The clutch 71 may be an electrically actuated one which is operable to uncouple the carriage 40 from the optics drive system. In accordance with an alternative embodiment the clutch 71 may be a friction or slip clutch of conventional design. For example, note the slip clutch in U.K. Pat. No. 1,336,819. The friction clutch 71 allows the mirror carriage 40 to be fixed at any desired position along its path of travel while the mirror carriage 50 continues its translation to a desired holding position such as the end of scan position.

If an electric clutch 71 is utilized, interception of the mirror carriage 40 by the selectively positionable stop 100 could operate to disengage the clutch by means of a suitably actuated switch and thereby disengage the full rate drive pulley 70 from the optics drive shaft 61. Restoration of the optical system 24 to its base configuration may be accomplished by timing the reactuation of the clutch 71 in a conventional fashion so that the full rate mirror carriage 40 is engaged to the drive shaft 61 at an appropriate time so that it is properly coordinated to the position of the half rate mirror carriage 50.

If a friction type clutch 71 is utilized, it is not necessary to actually disengage the mirror carriage 40 from the drives. In this instance an interception of the mirror carriage 40 by a stop 100 would cause it to cease its travel and be held at the desired position. The friction clutch 71 would then allow the drive pulley 70 to slip on the optics drive shaft 61 which would continue to rotate and advance mirror 27 to its end of scan position through the action of pulley 73 and cable 79. The mirror 27 would then be locked at the end of scan position by latch 90.

When the variable magnification mode of operation is no longer desired, the mirrors 26 and 27 are unlatched and allowed to fly-back to their start of scan or home position. Since the full rate mirror carriage 40 has been stopped short of its usual length of travel by the stop 100, it will reach the start of scan position before the half rate mirror carriage 50 reaches its start of scan position. The friction clutch 71 will then allow the full rate drive pulley 70 to slip on the optics drive shaft 61 until the half rate mirror carriage 50 reaches its start of scan position.

This unique arrangement allows the optical system 24 in accordance with this embodiment to be self-restoring. The only mechanism required for selectively positioning and holding the full rate mirror 26 along its path of travel are selectively actuable stops 100 which intercept the mirror carriage 40 to hold it at the desired position 30', 30'', etc.

In the embodiment shown the selectively actuable stops 100 comprise stop members 102 and 103 actuated by solenoids 104 and 105. The two selectively actuated stop members 102 and 103 correspond to the two reduction magnification viewing or imaging positions 30' and 30'', respectively, for the mirror 26 shown in FIG. 1. Solenoid actuated stop member 102 is shown in a position to intercept the mirror carriage 40, whereas solenoid actuated stop member 103 is shown in its normally retracted position.

The apparatus of FIG. 1 is provided with a document feeder 35. During normal operation, that is, when moving mirror scanning is utilized to provide a flowing light image of a stationary original, the document feeding assembly may be maintained in a stored position away from the platen 23 to expose the entire platen area and thus provide a maximum working area for the operator.

To initiate a moving original mode of exposure, the machine operator places the document feeder 35 in the operable position over the platen, and selects by means of a switch (not shown) the moving mode of exposure. This causes a signal to be sent to the main drive motor M, and at the same time a signal to be sent to the machine logic control system for conditioning the machine for moving original exposure selectively at one of a plurality of magnifications. This latter step is required in order to move the optical system 24 from its normal start of scan position at the left hand end of the platen surface to a desired viewing position beneath the document feeder.

During this initial conversion phase no original is actually being processed and, therefore, a copy is not fed. To prevent the feeding of a copy, a means is provided for inhibiting the action of the paper feeder during the period when the machine is being converted to moving original mode of exposure. Further details concerning a paper feed inhibiting mechanism which could be utilized in accordance with the present invention may be found in the aforenoted Hoppner et al. patents.

Figure 3:
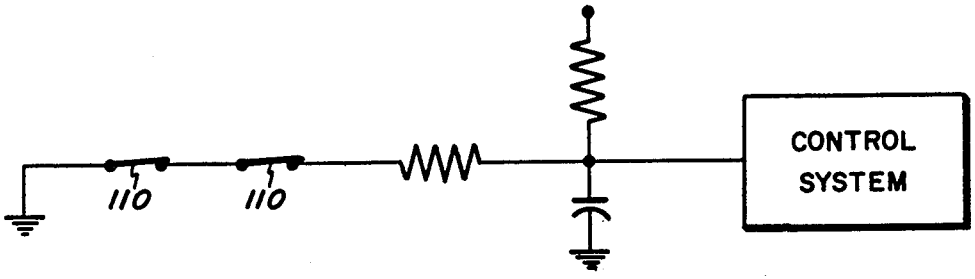
FIG. 3 PRIOR ART
FIG. 3 is an electrical schematic diagram of a prior art exposure initiating control system for a reproducing machine.

Referring now to FIG. 3, there is shown a prior art system for operating a copier in a moving original mode of exposure. In this system a pair of switches 110, as in FIG. 1, are utilized as start print switches and are operative upon being actuated by the lead edge of the sheet being advanced. In FIG. 3, two such switches are shown and in practice as in the Xerox 3100 LDC copier two such switches which are spaced apart along a line transverse to the direction of sheet feed are employed. Actuation of one or both of the switches 110 causes them to be opened and to signal the start of operation to the copying machine control system, which as in the 3100 LDC copier, programs the respective machine operations described above in an appropriately timed sequence so that there is proper registration between the copy sheet and the original document.

Optical exposure of the document therefor takes place in a timed relationship to the actuation of the switch 110 by the lead edge of the document. Normally the switch 110 is positioned upstream of the viewing position 30 so that exposure takes place at some time interval following switch actuation. When copying at varying magnifications using moving original exposure the document lead edge, from which exposure initiation is timed, moves at different velocities depending on the magnification selected. Therefore, if the time interval from switch 110 actuation to exposure is set for 1:1 copying, and a reduction mode is selected, the document being advanced will reach the viewing position 30 before the time interval has expired. Therefore, the time interval must be adjusted relative to the magnifications which is selected.

In accordance with this invention the viewing positions 30 are shifted depending on the projected image magnification selected. This necessitates a further adjustment of the time interval from switch 110 activation to exposure so that exposure will occur at the appropriate viewing position.

In the apparatus of FIG. 1, for purposes of example, it will be assumed that position 30 corresponds to a 1:1 ratio of original image to projected image magnification, and that positions 30' and 30'' correspond to first and second reduction ratios, respectively. The amount of reduction being greater for position 30'' than for position 30'. Correspondingly, therefor, the velocity at which the document feeder will advance the document will be greatest when viewing position 30'' is selected; somewhat slower when viewing position 30' is selected; and still slower when viewing position 30 is selected.

Therefore, one of a plurality of selectable time delays is provided between the actuation of the start print switches 110 and the initiation of optical exposure. Each time delay is selected to compensate for the changes in viewing position 30 and document velocity associated with the magnification selected.

The moving original mode of exposure with the smallest time delay between switch 110 actuation and optical exposure comprises a base mode, and all other modes of moving original exposure at whatever magnification are considered in reference to the base mode. If it is assumed that the smallest time delay will be associated with the document being advanced at the highest velocity, then the base mode would correspond to the mode of greatest reduction which would correspond in turn to viewing position 30''. In practice, however, depending upon the effect of viewing position on the time delay the base mode may not be the one of greatest reduction. For purposes of simplicity, however, it will be assumed to be the case for this description.

Figure 5:
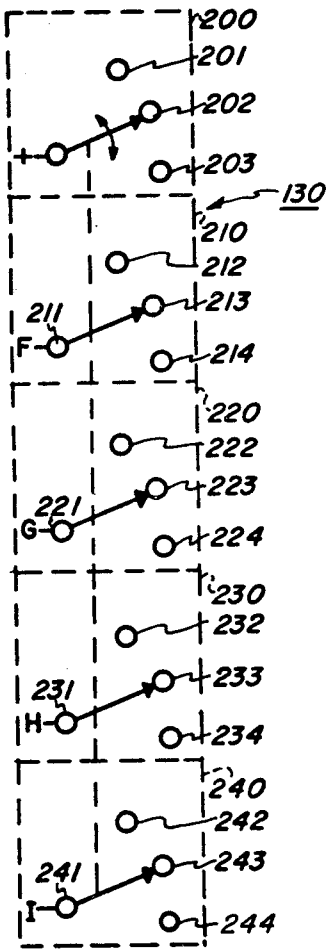
FIG. 5 is a more detailed schematic representation of the selector mechanism in FIG. 4.
Figure 4:
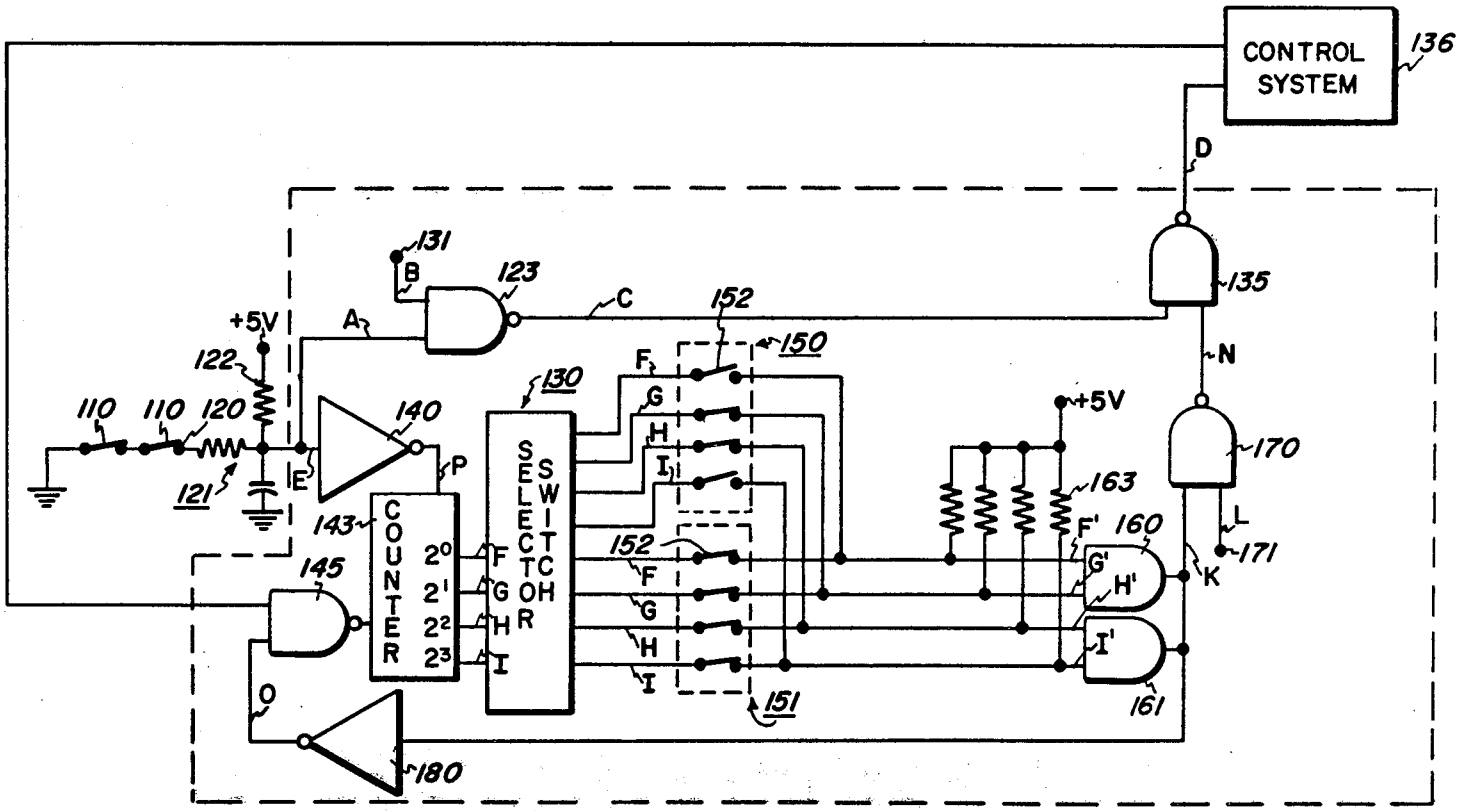
FIG. 4 is an electrical schematic of an exposure initiating control system for a reproducing apparatus in accordance with the present invention.

The time delay may be accomplished by any desired means. The means which are shown in FIGS. 4 and 5 comprise a preferred embodiment in accordance with the present invention, however, the invention is not intended to be limited thereto. The means which will be described comprises a time delay circuit which is the subject of U.S. application Ser. No. 627,433 to O'Connell, filed Oct. 30, 1975.

Referring to FIGS. 4 and 5, upon the actuation (opening) of a print switch 110 a signal appears at terminal 120 which comprises the input of a noise suppression circuit 121 comprising the resistor and capacitor in the conventional arrangement shown. Pull up resistor 122 provides a high level signal A at one input of NAND gate 123. The other input of the NAND gate 123 is tied to the mode selector switch 130 through terminal 131. Further details concerning the mode selector switch can be found by reference to FIG. 5.

If a base mode of magnification is selected, then a high level signal B is applied to the second input to NAND gate 123. Upon the concurrence of high level signals A and B at each of the inputs to the NAND gate 123, a low output signal C is generated which is applied to one of the inputs of NAND gate 135. This results in a high signal D on the output of NAND gate 135 which acts to initiate a copying run by application to the machine control system 136 in the same manner as the direct application of the start print signal from the start print switch of a conventional apparatus as in FIG. 3.

If, a mode of exposure is selected wherein a greater time delay is required, then it is necessary to increase the time delay from switch 110 actuation to optical exposure as aforenoted. In this case, the mode selection switch 130 will provide a low signal B at the input to NAND gate 123, thereby disabling this gate. A high signal E is applied to the input to inverter 140 which provides a low signal P at its output.

The time delay is provided by means of a four bit binary counter 143. The low signal P from inverter 140 is applied to counter 143 to enable the counter. The counter counts clock pulses which are gated to it from the master clock (not shown) of the machine's control system through NAND gate 145. Four output signals F, G, H, and I, from the binary ring counter corresponding to desired binary numbers are routed by means of the selector switch 130 through a first 150 or second 151 bank of switches 152 to respective inputs of AND gate decoders 160 and 161. Pull up resistors 163 are provided in each input line to the decoding gates 160 and 161 to provide high signals F', G', H', and I' at a given input if the switch in the respective line is open.

By opening or closing the switches 152 in the respective switch banks 150 and 151 one can decode any desired count within the range of the counter to provide an output signal K from the decoding AND gates 160 and 161 indicating the end of the time delay interval.

The use of "in-line" switch banks 150 and 151 as shown, enables the time delay interval to be adjusted for each mode of operation. The selector switch 130 is operative with respect to the mode of operation selected to route the signals F, G, H, and I, from the counter 143 to one or the other banks 150, 151 of in-line switches depending on the mode selected. For the counter 143, time intervals of from 0 to 15 counts can be decoded which would correspond to a time interval of 0 to 0.25 seconds assuming a 60 hertz clock pulse is gated to the counter. In the embodiment shown in FIG. 4, switch bank 150 will decode a count of 6 whereas switch bank 151 will decode a count of 15. The counts which will be decoded can be adjusted, as desired, by selectively opening or closing the respective switches 152 in each bank 150 or 151.

The output signal K from the NAND gate decoders 160 and 161 corresponding to the end of the time delay is applied to an input terminal of NAND gate 170. The second input of NAND gate 170 is connected to the mode selecting switch through terminal 171. When a mode other than the base mode is selected the second input signal L to NAND gate 170 is high. When the appropriate count is decoded by the gates 160 and 161 the output signal K is high so that the output signal N of NAND gate 170 is low. The low signal N from gate 170 is applied to NAND gate 135 resulting in a high signal D at the output of gate 135 which is applied to the machine control system 136 to initiate the copying operation. The high signal K at the output of decoding AND gates 160 and 161 is applied to the input of inverter 180 providing a low output signal 0 which is applied to one of the inputs of NAND gate 145 to disable it and stop further clock pulses from being gated into the counter. When the switches 110 are returned to their normally closed position, counter 143 is reset so that it is ready for the next copying operation.

FIG. 5 shows further details of the selector switch 130 set forth in FIG. 4. The selector switch comprises a ganged rotary wafer type switch. The first wafer switch 200 comprises a mode selection switch wherein the base mode or two alternative reduction modes of moving original exposure may be selected. The output terminal 201 corresponding to the base mode of moving original exposure is connected to terminal 131 of NAND gate 123. Output terminals 202 and 203 corresponding to other modes of moving original exposure are connected to terminal 171 of NAND gate 170. The signals at terminals 201, 202, 203, are also applied to the machine control logic to appropriately condition the machine by any desired means in the desired mode of moving original exposure.

Four additional wafer switches 210, 222, 230, and 240, are provided. The signals F, G, H, and I, are applied to terminals 211, 221, 231, and 241, respectively, of the wafer switches 210, 220, 230, and 240. Terminals 212, 222, 232, and 242 corresponding to a base mode selection are not operatively connected in the circuit. Terminals 213, 223, 233, and 243, correspond to selection of a reduction magnification mode of operation different from the base mode, and are connected to switch bank 150 to apply signals F, G, H, and I, to the respective switches 152 therein. Terminals 214, 224, 234, and 244, correspond in this embodiment to the selection of a 1:1 mode of moving original exposure and are connected to switch bank 151 to apply signals F, G, H, and I, to the respective switches therein.

The use of a ganged switch arrangement 130 provides mode selection and corresponding routing of the output signals from the counter to the appropriate switch bank 150 or 151.

The time delay circuit of FIGS. 4 and 5 does not form part of the present invention and the time delays could be provided by any desired means as are well known in the art.

Mode selection between stationary original and moving original exposure may be keyed to the movement of the document feeder 35 on and off the platen as in the Xerox 3100 LDC machine or in any other desired fashion as are known in the art.

Figure 7:
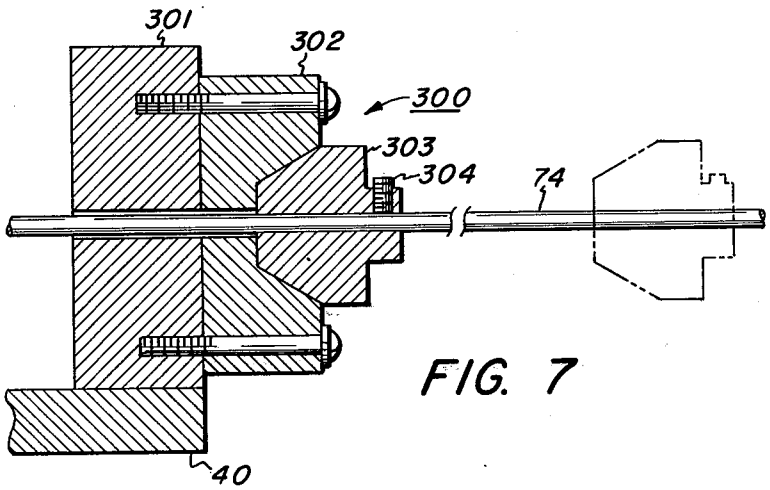
FIG. 7 is a partial cross-sectional view of an automatic uncoupling and recoupling drive system used in the apparatus of FIG. 6.
Figure 6:
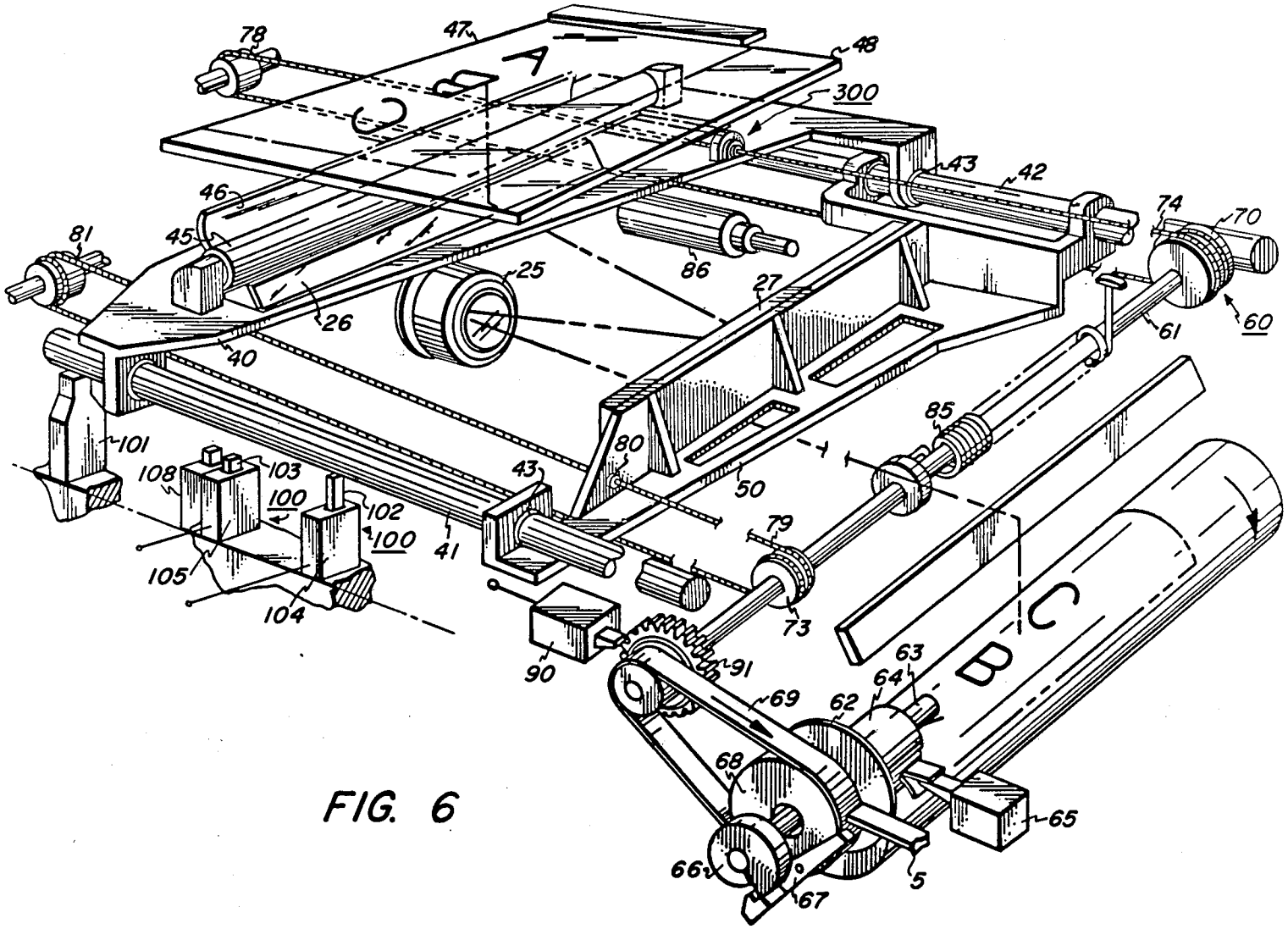
FIG. 6 is a perspective view of an optical exposure system including an alternative embodiment of the positioning system of this invention.

Referring now to FIGS. 6 and 7, an alternative embodiment in accordance with the present invention will be described. The apparatus of FIG. 6 is similar in most respects to that shown in FIG. 2 and, therefore, like elements have been given the same reference numerals. In accordance with the previously described embodiment the full rate drive pulley 70 is mounted to the optics shaft 61 through a friction clutch 71 or electromagnetic clutch. When the friction clutch is employed the drive system is continuously engaged to the full rate carriage 40. When the electromagnetic clutch is utilized the full rate carriage 40 is selectively uncoupled from the drive system.

In accordance with the embodiment of FIG. 6, an alternative approach to the selective uncoupling of the full rate carriage 40 from the drive system is shown. In accordance with this approach the full rate drive pulley 70 is pinned to the optics drive shaft 61 and a quick-connect and disconnect type of coupling 300 is utilized to connect the drive cable 74 to the full rate carriage 40.

As shown in FIG. 7 a catch member 303 is supported by the drive cable 74 and a latch member 302 is supported by the mirror carriage 40. The catch 303 and latch 302 members in accordance with this embodiment may comprise a mechanical catch and latch arrangement similar, for example, to a conventional cabinet type catch and latch arrangement or it may comprise in accordance with the most preferred embodiment a magnetically coupled catch and latch arrangement.

The full rate mirror carriage 40 includes a support member 301 for supporting the latch member 302. The catch member 303 is secured to the drive cable 74 by means of a set screw 304. The cable 74 loosly passes through a hole in the latch member and support member.

One of the catch 303 or latch 302 members is formed of a magnetic material such as Alnico and the other is formed of a material which may be attracted magnetically such as steel. The catch member 303 includes a beveled male portion and the latch member includes a cooperatively formed beveled female portion such that in their operatively engaged position the catch member is very accurately seated in the latch member thereby restoring with a high degree of accuracy the relative coordinated positions of the full rate 26 and half rate 27 mirrors. The beveled portion of the catch member also allows it to be easily relocated within the latch member. Preferably a permanent magnetic material is used for the latch member 302, however, if desired, the latch member could comprise an electromagnet selectively actuated to provide the operative engagement.

For scanning operation the catch 303 and latch 302 are coupled together magnetically as shown in solid lines so that the carriage 40 is drivingly engaged to the cable 74, and is, therefore, scanned and returned in the manner described with reference to the previous embodiment.

When it is desired to reposition the full rate mirror 26 relative to the half-rate mirror 27 for moving original exposure, selectively actuable stops 100 as in the previous embodiment are employed for intercepting the full-rate carriage 40 at a desired position intermediate its home or start of scan position and its end of travel or end of scan position. Upon the stopping of the full-rate mirror 26 through interception of the selectively actuable stop 100, the catch member 303 automatically is pulled out of coupling engagement with the latch member 302 upon continued movement of the cable 74 as shown in phantom so that the mirror carriage 40 is uncoupled from the drive system 60.

The arrangement shown in FIG. 7 is most preferred because it allows highly accurate restoration of the original coordinated positions of the mirrors 26 and 27.

It is possible to use a magnetically coupled catch and latch arrangement in accordance with this invention because the weight of the mirror carriage 40 and mirror 26 need not be very great through the use of appropriately supported plastic materials as in accordance with commercial practice, for example, in the Xerox 3100 LDC machine. The weight of the mirror carriage and mirror in accordance with this invention need not be significantly greater than somewhat over a pound and, therefore, the frictional resistance associated with moving it along the scan rails is not very great. The use of a magnetic coupling should be more than adequate to maintain operative engagement of the catch and latch during scanning and yet be relatively easily uncoupled when the carriage intercepts the selectively actuable stop member 100.

When one employs a system which uncouples the full rate mirror 26 from the drive system 60, the full rate carriage 40 is held in its position through its frictional engagement. As just described, the frictional resistance in the scanning system 24 is relatively low. Therefore, in accordance with a most preferred approach, a solenoid actuated latch 108 is provided which is actuated after the carriage is stopped by the selectively actuable stop 100 to latch the full rate mirror carriage in the desired position and prevent its movement during operation in the moving original exposure mode. Only one latch solenoid 108 has been shown in FIG. 6 for purposes of simplicity, however, it should be apparent that such a latch would be employed with each selectively actuable stop member 100. Similarly, it should be apparent that such a solenoid actuated latch mechanism could also be employed in accordance with the previous embodiment when an electromagnetic clutch is used.

While the invention has been described by reference to an embodiment employing two scanning mirrors and a half lens in the optical system, any desired system could be used.

The number of viewing positions and selectable projected magnifications in accordance with this invention may be set as desired and can be made infinitely variable by means well known in the art.

It is not necessary in accordance with the present invention for all of the viewing positions to lie within the domain of a document platen. Discrete viewing positions outside the domain of a document platen could be employed as in the aforenoted Vola patent.

The patents, patent applications, and texts specifically set forth in this application are intended to be incorporated by reference into the description.

The term electrostatographic as employed in the present application refers to the formation and utilization of electrostatic charge patterns for the purpose of recording and reproducing patterns in viewable form.

It is apparent that there have been provided in accordance with this invention apparatuses which fully satisfy the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a reproducing apparatus for producing copies of a document comprising:

a photosensitive surface arranged for movement at a given velocity;

means for viewing a document and for projecting an image thereof onto said surface, said viewing means including a first optical element and means for supporting said first optical element for movement along a first path of travel between a home position and an end of travel position;

drive means for moving said element between its respective home and end of travel positions;

a flexible member coupling said drive means to said element, said drive means being arranged to advance said flexible member in a first direction to move said element from said home position to said end of travel position or in a generally opposing second direction to return said element to its home position; and means for selectively fixing said element at a desired position along its path of travel between said home and end of travel positions; the improvement wherein, said apparatus further includes:

means for automatically uncoupling said flexible member from said optical element responsive to said fixing of said element at said desired position and the continued movement of said flexible member in said first direction, and for automatically recoupling said flexible member to said optical element upon movement of said flexible member in said second direction to return said element to said home position.

2. An apparatus as in claim 1, wherein said means for automatically uncoupling said flexible member from said optical element and for recoupling said flexible member to said optical element includes means for magnetically coupling said flexible member to said optical element.

3. An apparatus as in claim 2, wherein said magnetic coupling means includes a first member connected to said element and a second member connected to said flexible member, and wherein one of said first and second member comprises a magnet and the other of said first and second members is formed of a material which may be attracted magnetically, whereby when said first and second members are magnetically coupled together said flexible member is coupled to said element and when said element is stopped continued movement of said flexible member separates said first and second members to break said magnetic coupling.

4. An apparatus as in claim 1, wherein said optical element comprises a reflector and wherein a carriage means is provided for supporting said reflector for movement between said home and end of travel positions, said apparatus further including selectively actuable means positioned along said path of travel of said reflector and carriage means for stopping said reflector at said desired position.

5. An apparatus as in claim 4, including a plurality of spaced apart selectively actuable means for stopping said reflector at one of a plurality of desired positions.

6. An apparatus as in claim 5, wherein said selectively actuable stop means include stop members arranged for movement between a retracted position in non-interfering relationship with the movement of said carriage means and an extended position for intercepting said carriage means to stop said reflector and means for selectively moving said stop members between said extended and retracted positions.

7. An apparatus as in claim 6, wherein said means for moving said stop members comprise solenoids.

8. An apparatus as in claim 3, wherein said first member is supported by said carriage and wherein said second member is supported by said flexible member and wherein said first and second members include conforming mating surfaces to provide accurate recoupling of said first and second members.

9. An apparatus as in claim 8, wherein said reproducing apparatus comprises an electrostatographic reproducing apparatus including means for forming an electrostatic image on said surface; means for developing said electrostatic image to render it visible; and means for transferring said visible image to a sheet of final support material.

10. In a reproducing apparatus for producing copies of a document selectively at one of a plurality of copy image magnifications comprising:

a photosensitive surface arranged for movement at a given velocity;

a plurality of document viewing positions corresponding to different desired copy image magnifications;

means for viewing said documents selectively at any desired one of said viewing positions and for projecting an image thereof onto said surface selectively at one of said plurality of magnifications corresponding to said one viewing position, said viewing means comprising:

a first optical scanning element;

means for supporting said first element for movement along a first path of travel between a home position and an end of scan position;

a second optical scanning element;

means for supporting said second element for movement along a second path of travel between a home position and an end of scan position;

means connected to said elements for driving them between their respective home and end of scan positions and for coordinating their movement to maintain a constant conjugate distance during scanning movement;

means for advancing said document past said viewing positions selectively at a velocity proportionally synchronized to the velocity of said surface;

means for changing the optical distance between said first and second scanning optical elements comprising:

means for selectively fixing said first optical element along its path of travel to view said document at a desired one of said viewing positions;

the improvement wherein said means for selectively fixing said first optical element comprises;

selectively actuable means arranged along said first path of travel for stopping said first element at said desired position while said second element continues to advance along its path of travel; and means for fixing said second element at a desired position along its path of travel.

11. An apparatus as in claim 10, further including clutch means connecting said driving means to said first element for allowing said drive means to continue to advance said second element after said first element has stopped.

12. An apparatus as in claim 11, wherein said clutch means comprises a friction clutch.

13. An apparatus as in claim 12, wherein said first and second elements comprise reflectors.

14. An apparatus as in claim 10, further including means for automatically connecting and disconnecting said drive means to said first element responsive to the stopping of said first element and the continued operation of said driving means.

15. An apparatus as in claim 14, wherein said automatic connecting and disconnecting means includes means for magnetically coupling said driving means to said first element.

16. An apparatus as in claim 15, wherein said magnetic coupling means includes a first member connected to said first element and a second member connected to said driving means and wherein one of said first and second members comprises a magnet and the other of said first and second members is formed of a material which may be attracted magnetically, whereby when said first and second members are connected together they are magnetically coupled and when said first element is stopped continued operation of said driving means separates said first and second members to break said magnetic coupling.

17. An apparatus as in claim 10, wherein said first and second elements comprise reflectors and wherein first and second carriage means is provided respectively for supporting said first and second reflectors for movement between said home and end of scan positions.

18. An apparatus as in claim 17, including a plurality of spaced apart selectively actuable means for stopping said first reflector at one of a plurality of desired positions.

19. An apparatus as in claim 18, wherein said selectively actuable stop means includes stop members arranged for movement between a retracted position in non-interfering relationship with the movement of said first carriage means and an extended position for intercepting said first carriage means to stop said reflector and means for selectively moving said stop members between said extended and retracted positions.

20. An apparatus as in claim 18, wherein said means for moving said stop members comprises solenoids.

21. An apparatus as in claim 16, wherein said first member is supported by said first carriage, and wherein said first and second members include conforming mating surfaces to provide accurate recoupling of said first and second members.

22. An apparatus as in claim 19, wherein said reproducing apparatus comprises an electrostatographic reproducing apparatus including means for forming an electrostatic image on said surface; means for developing said electrostatic image to render it visible; and means for transferring said visible image to a sheet of final support material.

* * * * *